US005571998A

United States Patent [19]

Momoi

[11] Patent Number: 5,571,998

[45] Date of Patent: Nov. 5, 1996

[54] FUNCTION SWITCHING DEVICE FOR INFORMATION PROCESSING APPARATUS

[75] Inventor: Akira Momoi, Yamanashi, Japan

[73] Assignee: NEC Corporation, Tokyo, Japan

[21] Appl. No.: 332,057

[22] Filed: Nov. 1, 1994

[30] Foreign Application Priority Data

Nov. 5, 1993 [JP] Japan ..... 5-276265

[51] Int. Cl.[6] ..... H01H 9/00; H01R 11/22

[52] U.S. Cl. ..... 200/50.28; 324/754; 439/269.1; 439/912

[58] Field of Search ..... 200/5 R, 6 R, 200/50 B, 333, 334, 50.01, 50.02, 50.28, 50.31; 439/269.1; 324/754

[56] References Cited

U.S. PATENT DOCUMENTS

| | | | |
|---|---|---|---|
| 4,081,694 | 3/1978 | Abdoo | 307/129 |
| 4,348,636 | 9/1982 | Doundovlakis | 395/183.22 |
| 4,352,964 | 10/1982 | English | 200/6 R |
| 4,389,549 | 6/1983 | Brown | 200/5 R |
| 4,749,362 | 6/1988 | Haffman et al. | 439/269.1 |
| 4,924,179 | 5/1990 | Sherman | 324/755 |
| 5,075,516 | 12/1991 | Brovillette | 200/5 R |

FOREIGN PATENT DOCUMENTS

| | | | |
|---|---|---|---|
| 2174392 | 10/1973 | France | H01R 13/00 |
| 2207404 | 6/1974 | France | H05K 13/00 |
| 58-154676 | 9/1983 | Japan | G01R 31/02 |
| 60-171543 | 9/1985 | Japan | G06F 11/02 |
| 63-207674 | 8/1988 | Japan | B41J 19/76 |
| 1-180160 | 7/1989 | Japan | H04L 13/00 |
| 6-189058 | 7/1994 | Japan | H04N 1/00 |

*Primary Examiner*—J. R. Scott
*Attorney, Agent, or Firm*—Young & Thompson

[57] ABSTRACT

In a function switching device for an information processing apparatus, a function switching unit is mounted to a DIP switch. The DIP switch is arranged to face the mounting port-side edge of a printed circuit board, mounted in the information processing apparatus, to be parallel to the edge. A control unit outputs a function switching signal to the function switching unit. A signal cable connects the function switching unit and the control unit. The function switching unit includes a pair of clip segments, a pivot shaft, springs, resetting distal end, and a plurality of contacts. The pivot shaft pivotally supports both the clip segments. The springs normally bias both the clip segments in a closed direction. The resetting distal end is provided at the central portion of the front side of one clip segment. When the function switching unit is mounted to the board, the resetting distal end resets knobs of the DIP switch to an initial state. The plurality of contacts are arranged to extend forward from the other clip segment. When the function switching unit is mounted to the DIP switch, the plurality of contacts are brought into contact with the leads of switch contacts of the DIP switch that project from the rear surface of the board.

3 Claims, 4 Drawing Sheets

FIG.4A
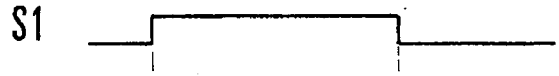
FIG.4B
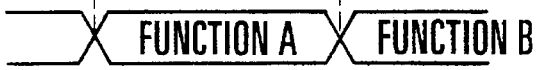
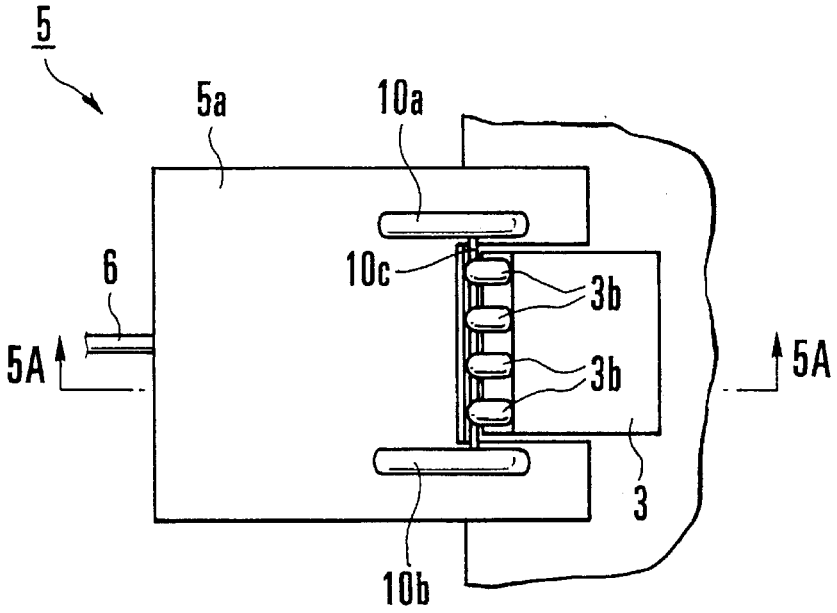
FIG.5A
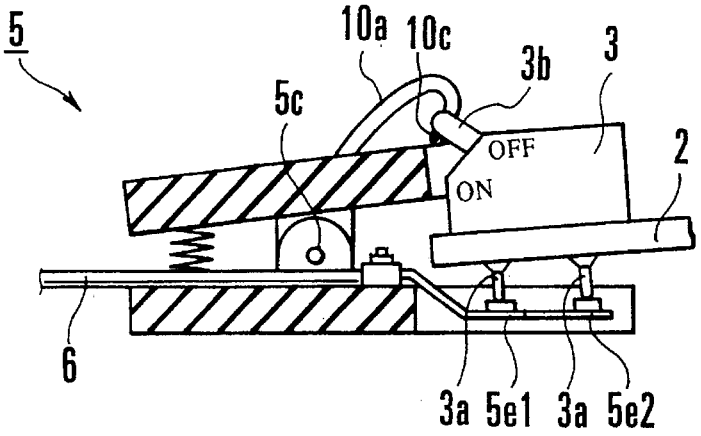
FIG.5B

FUNCTION SWITCHING DEVICE FOR INFORMATION PROCESSING APPARATUS

BACKGROUND OF THE INVENTION

1. Field of the Invention

The present invention relates to a function switching device for an information processing apparatus incorporating in particular a printed circuit board to which a DIP switch is attached.

2. Description of the Related Art

To inspect the operation of an information processing apparatus by switching the function of the information processing apparatus, conventionally, a DIP switch provided to the information processing apparatus is manually operated and switched by an operator, and thereafter whether or not the information processing apparatus executes a predetermined operation in accordance with this switching operation is visually confirmed by the operator.

However, according to this conventional function switching method for an information processing apparatus, the functions of the information processing apparatus cannot be switched unless the DIP switch is operated by the operator. Thus, remote control or unmanned control cannot be performed. Also, the operation after function switching must be confirmed by the operator.

SUMMARY OF THE INVENTION

It is, therefore, a principal of the present invention to provide a function switching device for an information processing apparatus, capable of performing remote control and unmanned control.

In addition to the above object, it is another object of the present invention to provide a function switching device for an information processing apparatus, the operation of which after function switching can be confirmed in an unmanned manner.

In order to achieve these objects, according to an aspect of the present invention, there is provided a function switching device for an information processing apparatus, comprising a function switching section mounted to a DIP switch arranged to face a mounting port-side edge of a printed circuit board and to be parallel to the edge, the printed circuit board being mounted in the information processing apparatus, a control unit for outputting a function switching signal to the function switching section, and a signal cable for connecting the function switching section and the control unit, the function switching section comprising a pair of clip segments, a pivot shaft for pivotally supporting both of the clip segments, springs for normally biasing both the clip segments in a closing direction, means, provided at a central portion of a front side of one clip segment, for resetting knobs of the DIP switch to an initial state when the function switching section is mounted to the board, and a plurality of contacts arranged to extend forward from the other clip segment and brought into contact with leads of switch contacts of the DIP switch that project from a rear surface of the board when the function switching section is mounted to the DIP switch.

BRIEF DESCRIPTION OF THE DRAWINGS

FIGS. 4A and 4B is a signal waveform chart showing reply signals sent and received by a control unit shown in FIG. 1; and FIGS. 5A and 5B are plan and sectional views, respectively, showing a function switching device according to another embodiment of the present invention.

DESCRIPTION OF THE PREFERRED EMBODIMENTS

Figure 1:
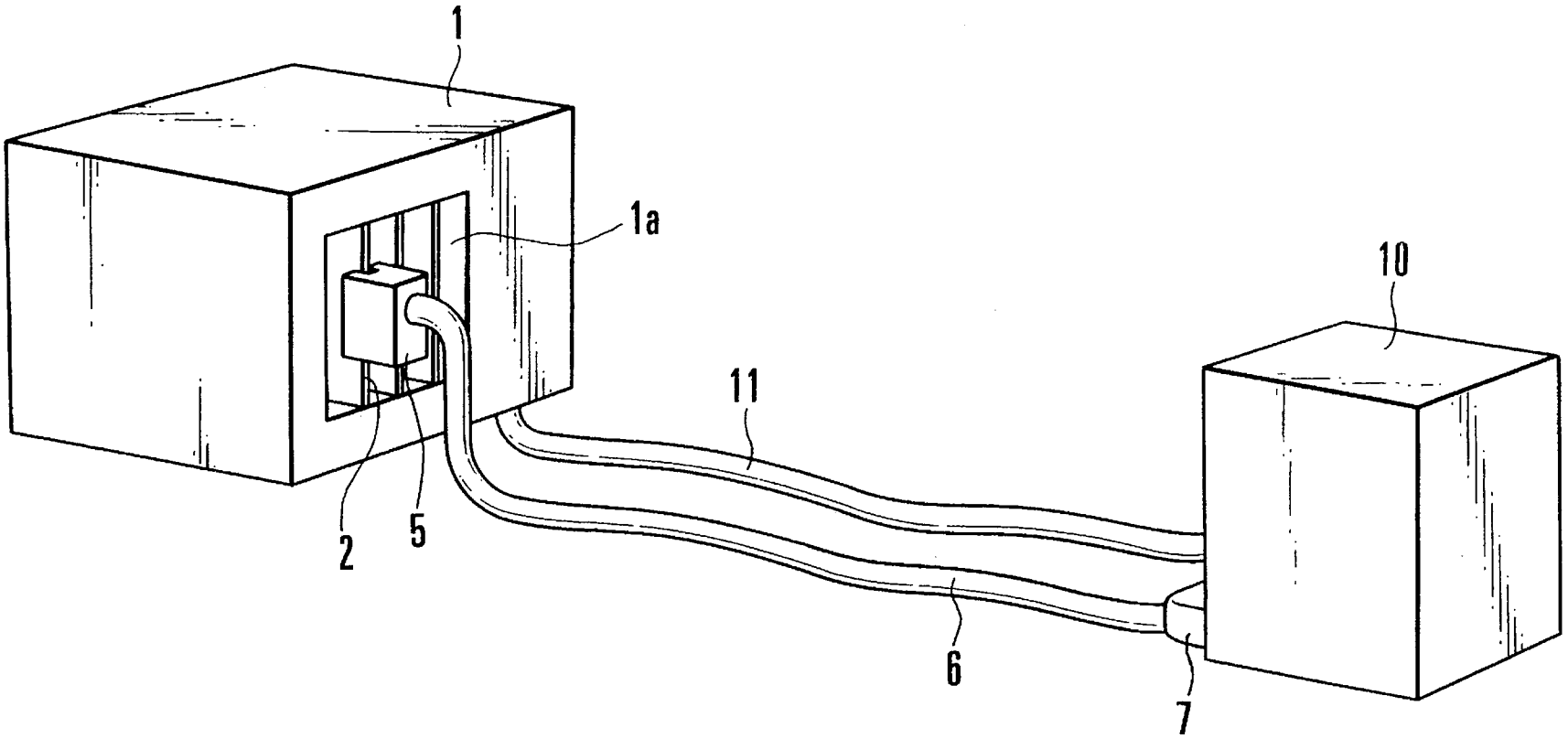
FIG. 1 is a system diagram showing a basic arrangement for explaining a function switching device for an information processing apparatus according to an embodiment of the present invention.
Figure 2:
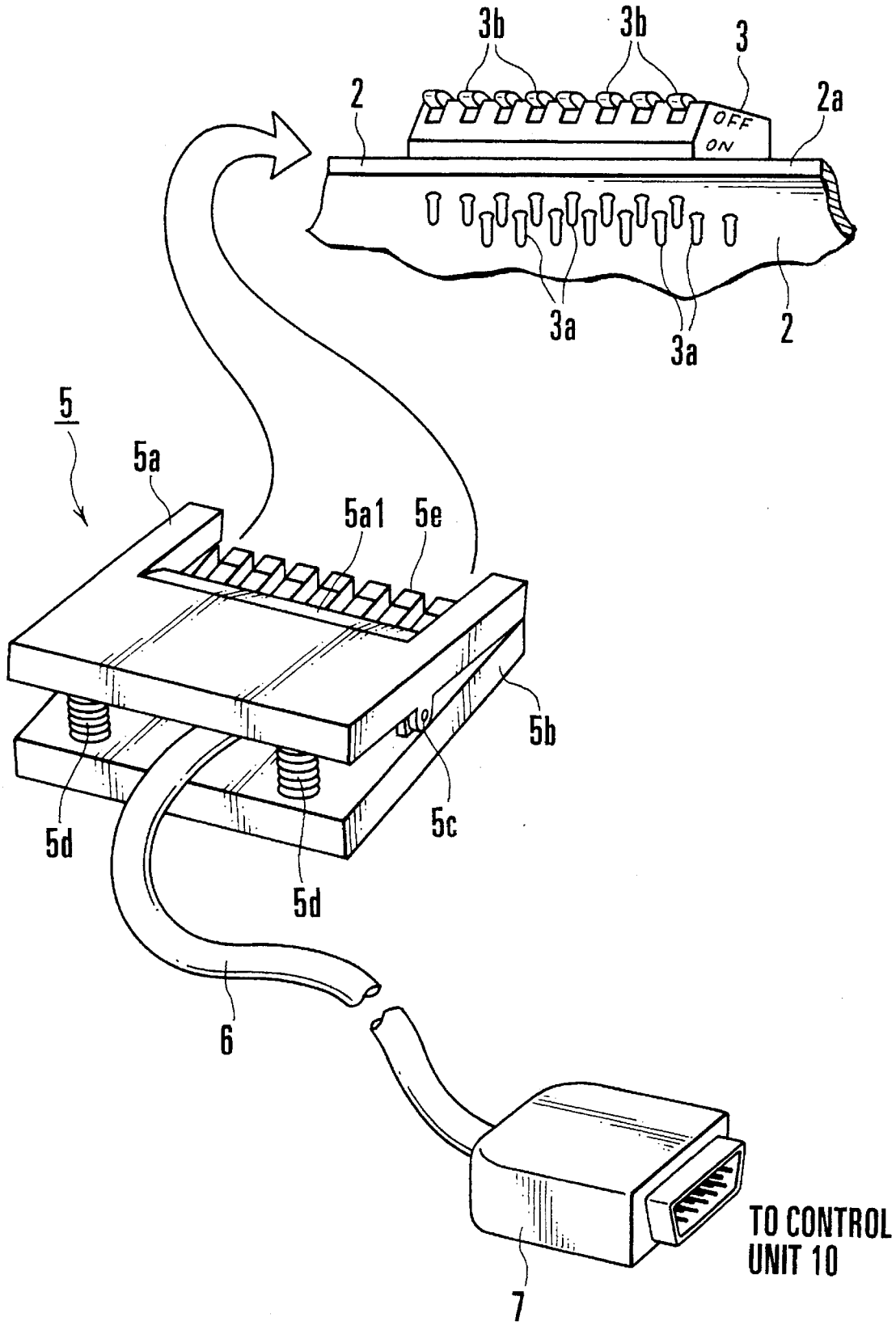
FIG. 2 is a diagram showing a detailed arrangement of the function switching device portion of FIG. 1.
Figure 3A:
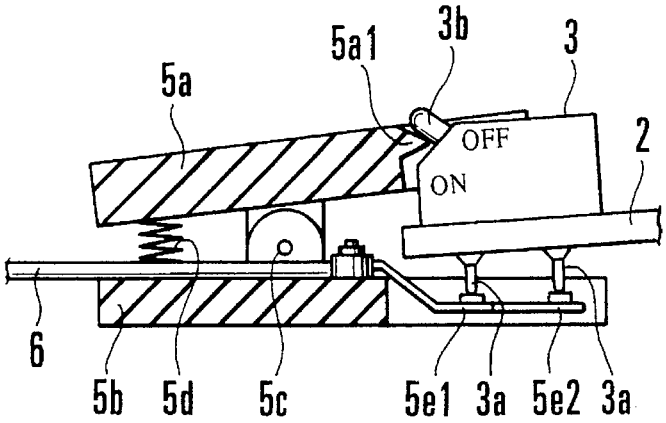
FIGS. 3A, 3B, and 3C are sectional, plan, and bottom views, respectively, of the function switching device shown in FIG. 2 mounted to a printed circuit board.
Figure 3B:
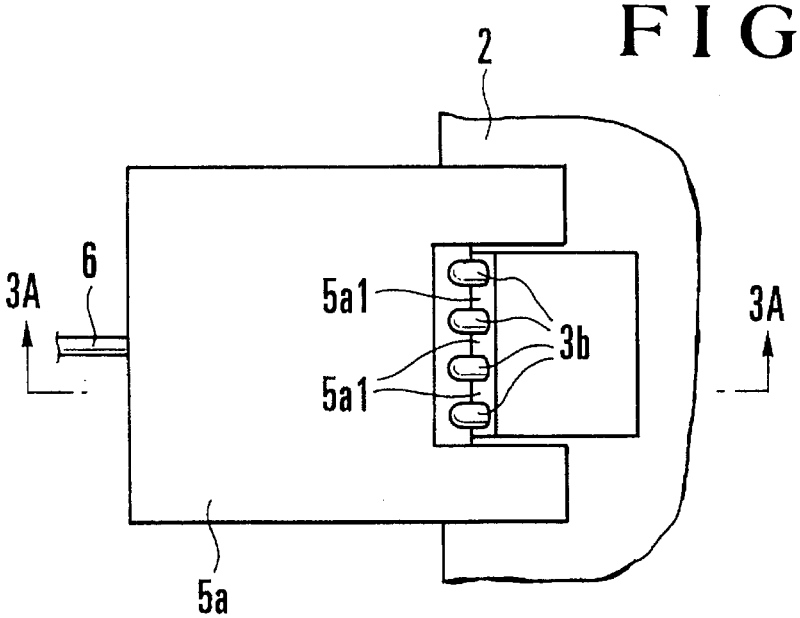
Figure 3C:
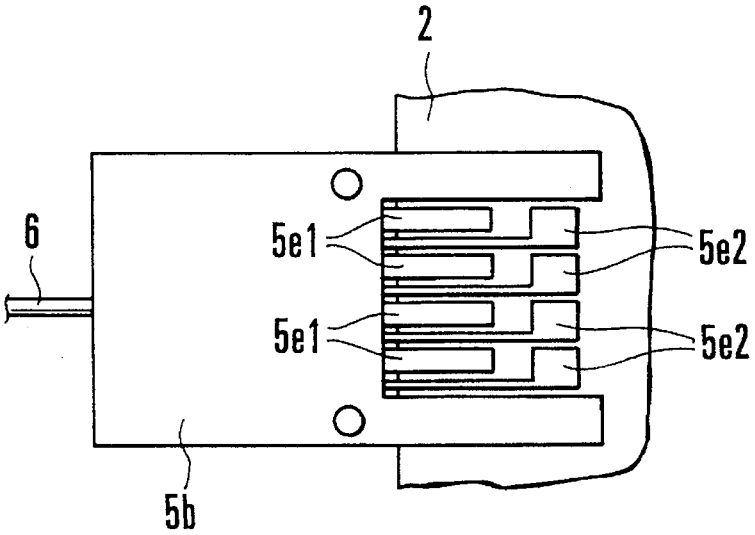

FIG. 1 shows a basic arrangement of a function switching device for an information processing apparatus according to an embodiment of the present invention, FIG. 2 shows a detailed arrangement of the function switching device, and FIGS. 3A, 3B, and 3C show a state wherein the function switching device is mounted to a printed circuit board. Referring to FIGS. 1 to 3C, an information processing apparatus 1 is, e.g., a personal computer, the function of which need be externally switched to inspect the operation or to alter the function. The information processing apparatus 1 usually incorporates at least one printed circuit board 2. A DIP switch 3 for switching the function is attached to a portion of the printed circuit board 2. The DIP switch 3 is mounted to face a board mounting port 1*a* of the information processing apparatus 1, and more specifically, is mounted to be parallel to an edge 2*a* of the printed circuit board 2 facing the board mounting port 1*a* so that it can be externally operated when it is normally mounted. Therefore, when the DIP switch 3 is attached to the printed circuit board 2, leads 3*a* of a plurality of switch contacts incorporated in the DIP switch 3 are generally aligned and project from the rear surface of the printed circuit board 2 to be parallel to the edge 2*a* of the printed circuit board 2, as best shown in FIG. 2.

A function switching unit 5 as the characteristic feature of the present invention is mounted to the DIP switch 3. The function switching unit 5 has a clip structure. The function switching unit 5 comprises two clip segments 5*a* and 5*b*, a pivot shaft 5*c*, springs 5*d*, and a plurality of contacts 5*e*. The pivot shaft 5*c* pivotally supports the clip segments 5*a* and 5*b*. The springs 5*d* pivot the clip segments 5*a* and 5*b* in a closing direction when the function switching unit 5 is detached from the DIP switch 3. When the function switching unit 5 is mounted to the DIP switch 3, the plurality of contacts 5*e* are brought into contact with the leads 3*a* of the switch contacts projecting from the rear surface of the printed circuit board 2 to which the DIP switch 3 is attached.

In this embodiment, these contacts 5*e* are constituted by two types of contacts. Contacts 5*e*1 of one type are brought into contact with the leads 3*a* of the switch contacts of the DIP switch 3 which are arranged close to the edge 2*a* of the printed circuit board 2 to be substantially parallel to it. Contacts 5*e*2 of the other type are brought into contact with the leads 3*a* of the switch contacts of the DIP switch 3 which are arranged far from the edge 2*a* of the printed circuit board 2 to be substantially parallel to it. The contacts 5*e*1 merely extend straight from the clip segment 5*b*, while the contacts 5*e*2 extend straight from the clip segment 5*b* and are then bent at an almost right angle with respect to the extending direction. The contacts 5*e*1 and 5*e*2 are different in this respect. The contacts 5*e*1 and 5*e*2 are fixed to the main body portion of the clip segment 5b with known fixing means. The contacts 5e1 and 5e2 of the function switching unit 5 are bundled at the main body portion of the function switching unit 5 and are connected to a control unit 10 through a signal cable 6 and a connector 7.

The control unit 10 sends a function switching signal as shown in FIG. 4 to the information processing apparatus 1 through the contacts 5e1 and 5e2, and receives a reply signal as shown in FIG. 4 indicative of function switching through a function confirmation signal cable 11. Thus, the control unit 10 incorporates, e.g., a personal computer. When the function switching type is designated from the keyboard of the personal computer, a function switching signal corresponding to this designation is sent to either one or a plurality of the contacts of the function switching unit 5. The function switching signal is a "1"- or "0"-level signal.

When the function of the information processing apparatus 1 is switched based on the function switching signal described above, the information processing apparatus 1 sends a reply signal as shown in FIG. 4 for confirming function switching to the control unit 10 through the function confirmation signal cable 11.

A method of mounting the function switching unit 5 of this embodiment to the printed circuit board 2 will be described.

In the embodiment shown in FIGS. 2 to 3C, before mounting, the distal ends of the clip segments 5a and 5b of the function switching unit 5 are closed by the biasing force of the springs 5d. The operator holds the rear ends of the clip segments 5a and 5b to open their distal ends, and pushes the function switching unit 5 from behind the printed circuit board 2, to which the DIP switch 3 is attached, to clamp the printed circuit board 2. Then, a distal end 5a1 of the central portion of the clip segment 5a goes under knobs 3b of the DIP switch 3. When the function switching unit 5 is further pushed toward the DIP switch 3, all the knobs 3b of the DIP switch 3 are set at the initial position (OFF position in this embodiment). As a result, the DIP switch 3 is reset to the initial position, so that it is set in an open state when seen from the side of the information processing apparatus 1.

When the function switching unit 5 is pushed up to a predetermined position, the operator releases his hand from the function switching unit 5. In this state, the contacts 5e1 and 5e2 are respectively in contact with the leads 3a of the switch contacts projecting from the rear surface of the printed circuit board 2.

In this state, the operator operates the control unit 10 to send a signal S1 as shown in FIG. 4. The signal S1 shown in FIG. 4A indicates a period during which required signals are selectively supplied to the contacts 5e1 and 5e2 for each function mode (function A mode in this embodiment). A signal S2 is a function confirmation signal which is sent back from the information processing apparatus 1 to the control unit 10 when the above signal S1 is output, and indicates the function A mode in this embodiment. FIG. 4B shows that the signal S1 indicating a function B mode is output after the function A mode. This function confirmation signal is one (e.g., a STATUS signal used in a personal computer) of the signals which are inevitably output in a general information processing apparatus. An explanation as to how the function confirmation signal is made by the information processing apparatus may be unnecessary. The signal S2 used in this case is usually output as an open collector signal or a relay contact signal.

By this operation, after mounting the function switching unit 5 to the information processing apparatus 1, the operator can perform mode switching of the information processing apparatus 1 from the control unit 10 side only by operating the control unit 10. This means that when a control unit is installed remote from the information processing apparatus, the information processing apparatus can be remote-controlled or unmanned-controlled. Also, the operating state of the information processing apparatus can be confirmed from the control unit side by sending a function confirmation signal from the information processing apparatus to the control unit, as in this embodiment.

FIGS. 5A and 5B show another embodiment of the present invention, and especially a modification of the function switching unit 5. Referring to FIGS. 5A and 5B, the same portions as in FIGS. 2 to 3C or portions having the same functions as those of the portions shown in FIGS. 2 to 3C are indicated by the same reference numerals. This embodiment is different from the above embodiment in a mechanism for resetting knobs 3b of a DIP switch 3 to the initial state during mounting of the DIP switch 3. More specifically, in this embodiment, one end of each of knob operating segment support portions 10a and 10b made of an elastic material is fixed to a portion of a clip segment 5a close to a corresponding end in the lateral direction. Each of the knob operating segment support portions 10a and 10B is an inverted U-shaped member. A knob operating segment 10c is supported by the knob operating segment support portions 10a and 10b. A corresponding one of the two ends of the knob operating segment 10c is connected to the other end of each of the knob operating segment support portions 10a and 10b. The knob operating segment 10c may be made of the same material as that of the knob operating segment support portions 10a and 10b, or other metals.

With this arrangement, when a function switching unit 5 is pushed toward an edge 2a at the rear end of a printed circuit board 2 of an information processing apparatus 1, the knob operating segment 10c is engaged with the knobs 3b of the DIP switch 3. When the function switching unit 5 is further pushed, the knob operating segment 10c resets the knobs 3b to the initial state by the cooperation of the biasing force of the knob operating segment support portions 10a and 10b. The effect obtained by this arrangement is the same as that obtained by the above embodiment.

In the embodiment shown in FIGS. 5A and 5B, even if the knob operating segment support portions 10a and 10b and the knob operating segment 10c are made of a metal having no elasticity or of a member having rigidity similar to that of a metal, the same operation and effect can be obtained, as a matter of course.

As has been described above, when the function switching method and device for an information processing apparatus according to the present invention are employed, function switching of the information processing apparatus and confirmation thereof, which are conventionally performed manually, can be automatically performed, and remote control and unmanned control can be performed.

What is claimed is:

1. A function switching device for an information processing apparatus, comprising a function switching section mounted to a DIP switch arranged to face a mounting port-side edge of a printed circuit board to be parallel to said edge, said printed circuit board being mounted in said information processing apparatus, a control unit for outputting a function switching signal to said function switching section, and a signal cable for electrically connecting said function switching section and said control unit, said function switching section comprising a pair of clip segments, a pivot shaft for pivotally supporting both said clip segments, springs for normally biasing both said clip segments in a closed direction, means, provided at a central portion of a front side of one clip segment, for resetting knobs of said DIP switch to an initial state when said function switching section is mounted to said board, and a plurality of contacts arranged to extend forward from the other clip segment and brought into contact with leads of switch contacts of said DIP switch that project from a rear surface of said board when said function switching section is mounted to said DIP switch.

2. An apparatus according to claim 1, wherein said means for resetting said knobs of said DIP switch to the initial state is constituted by a distal end portion of a central portion of one clip segment and has an inclined surface which is movable along a surface of said DIP switch during mounting.

3. An apparatus according to claim 1, wherein said means for resetting said knobs of said DIP switch to the initial state is constituted by inverted U-shaped spring members projecting forward from a distal end of one clip segment, and distal ends of said spring members are engaged with said knobs during mounting.

* * * * *